US006604638B1

(12) United States Patent
Primiano et al.

(10) Patent No.: US 6,604,638 B1
(45) Date of Patent: Aug. 12, 2003

(54) MERCHANDISING DISPLAY TRACK DEVICE WITH BOTTLE RAMP

(75) Inventors: Bernard Primiano, Marietta, GA (US); Daniel Literski, Smyrna, GA (US); Ming Sun, Roswell, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/095,277

(22) Filed: Mar. 11, 2002

(51) Int. Cl.[7] ..... A47F 1/04

(52) U.S. Cl. ..... 211/59.2; 312/72; 312/45; 211/74; 211/183

(58) Field of Search ..... 211/59.2, 59.3, 211/74, 183, 126.16, 126.1, 162, 71.01; D6/408; 312/42, 45, 72; 108/57.25, 57.28, 51.11

(56) References Cited

U.S. PATENT DOCUMENTS

| | | | | | |
|---|---|---|---|---|---|
| 4,105,126 | A | * | 8/1978 | Deffner et al. | 211/59.2 |
| 4,228,903 | A | * | 10/1980 | Eckert | 211/59.2 |
| 4,238,022 | A | * | 12/1980 | Williams | 193/32 |
| D266,297 | S | * | 9/1982 | Zaro | D6/408 |
| 4,998,628 | A | * | 3/1991 | Ross | 211/59.2 |
| 5,022,535 | A | | 6/1991 | Spamer | 211/59.2 |
| 5,396,997 | A | * | 3/1995 | Johnson | 211/59.2 |
| 5,531,336 | A | * | 7/1996 | Parham et al. | 211/183 |
| 5,624,042 | A | * | 4/1997 | Flum et al. | 211/59.2 |
| 5,634,564 | A | | 6/1997 | Spamer et al. | 211/59.3 |
| 5,695,076 | A | * | 12/1997 | Jay | 211/59.2 |
| 5,706,958 | A | * | 1/1998 | Spamer | 211/59.2 |
| 5,865,324 | A | * | 2/1999 | Jay et al. | 211/59.2 |
| 5,878,894 | A | * | 3/1999 | Robertson | 211/59.2 |
| 5,971,204 | A | * | 10/1999 | Apps | 221/92 |
| 5,992,651 | A | * | 11/1999 | Shaw et al. | 211/59.2 |
| 6,186,345 | B1 | * | 2/2001 | Robertson | 211/59.2 |
| 6,230,906 | B1 | * | 5/2001 | Padiak et al. | 211/85.18 |
| 6,253,930 | B1 | * | 7/2001 | Freidus et al. | 211/59.2 |
| 2001/0002659 | A1 | * | 6/2001 | Bada | 211/59.2 |
| 2002/0043509 | A1 | * | 4/2002 | Lajeunesse et al. | 211/59.2 |

FOREIGN PATENT DOCUMENTS

| | | | | |
|---|---|---|---|---|
| FR | 1456468 | * | 9/1966 | 211/59.2 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

A merchandising display shelf track device for receiving a row of articles for sliding movement therealong has a front track segment, a riser panel and a number of ribs. The front track segment has a base wall with a front portion and a rear portion. The riser panel is upstanding from the front portion of the base wall. The ribs are upstanding from the base wall and are attached to the riser panel. The top surface of the ribs is inclined at the front so that a bottle sliding along the track has its direction changed so that the bottle does not tip over.

10 Claims, 1 Drawing Sheet

MERCHANDISING DISPLAY TRACK DEVICE WITH BOTTLE RAMP

TECHNICAL FIELD OF THE INVENTION

This invention relates to a track device for a merchandising display shelf, and, more particularly, to a gravity feed track device for articles on the shelf, particularly bottles, to slide along.

BACKGROUND OF THE INVENTION

A display rack unit is assembled from multiple track devices for merchandising articles such as bottled or canned drink products. The display rack unit may include a plurality of elongated track devices detachably interconnected in side-by-side relationship at adjacent sidewalls. The number of track devices used to assemble the display rack unit is determined such that the overall size of the unit is suitable for placement onto an existing display shelf in a retail environment to fill the width of the shelf. Sometimes, a display rack unit has single or multiple track devices extruded or molded from a single piece of material for articles to slide along.

Articles in the track can be moved from the rear to the front for dispensing one at a time using gravity. Gravity feed can be achieved easily with a simple track device when the shelf on which the track device rests is inclined. When the shelf is not inclined but has an upwardly extending rear lip, ledge or back stop, gravity feed is still easily achieved with a simple track device that rests on the back stop to raise the rear of the device. A problem with gravity feed devices is that articles sometimes tip over as they feed forward down the track device. It is believed that the forward momentum of an article continues when the article is abruptly stopped by a front stop member at the front of the track device. Tipping is further encouraged by the fact that articles, especially bottles, may have a center of gravity that is situated at a higher elevation than the top of the front stop member. While raising the front stop member would reduce or eliminate tipping, it would obscure or interfere with product labeling and identification, which is undesirable. Accordingly, it will be appreciated that it would be highly desirable to have a device to prevent tipping that does not interfere with product labeling or presentation.

SUMMARY OF THE INVENTION

The present invention is directed to overcoming one or more of the problems set forth above. Briefly summarized, according to the present invention, a merchandising display shelf track device that is adapted to receive a row of articles for sliding movement therealong comprises a front track segment, a riser panel and one or more ribs. The front track segment has a base wall with a front portion and a rear portion, and the riser panel is upstanding from the front portion of the base wall. The ribs are upstanding from the base wall and are attached to the riser panel. Each rib has a front portion, a rear portion and a top surface extending between its front and rear portions. The rear portion is attached to and contiguous with the rear portion of the base wall while the front portion rises up from the front portion of the base wall. The top surface rises from being contiguous at the rear portion of the base wall to a position above the front portion of the base wall.

The raised top surface is the surface that the article slides along. Because the top surface is raised from the horizontal surface of the track device, it changes the momentum of the article sliding down the track device giving the article vertical velocity and decreasing horizontal velocity. The undesirable tendency of the article to tip over decreases as the horizontal velocity decreases.

The raised top surface interacts with the bottom of an article to further reduce the tendency to tip over. Articles, especially bottles, are constructed with a bottom that is not flat but has a concave or raised central portion to reduce friction and eliminate bulging which causes instability in many circumstances. The edge portion of the bottom of a bottle makes contact with the track device. As the bottle slides along, the leading edge goes up the top surface of the ramp changing the momentum, then slips down onto the ramp bringing the bottle to rest with the central portion of the bottom of the bottle on the ribs and riser, and lodged against the front of the track device.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
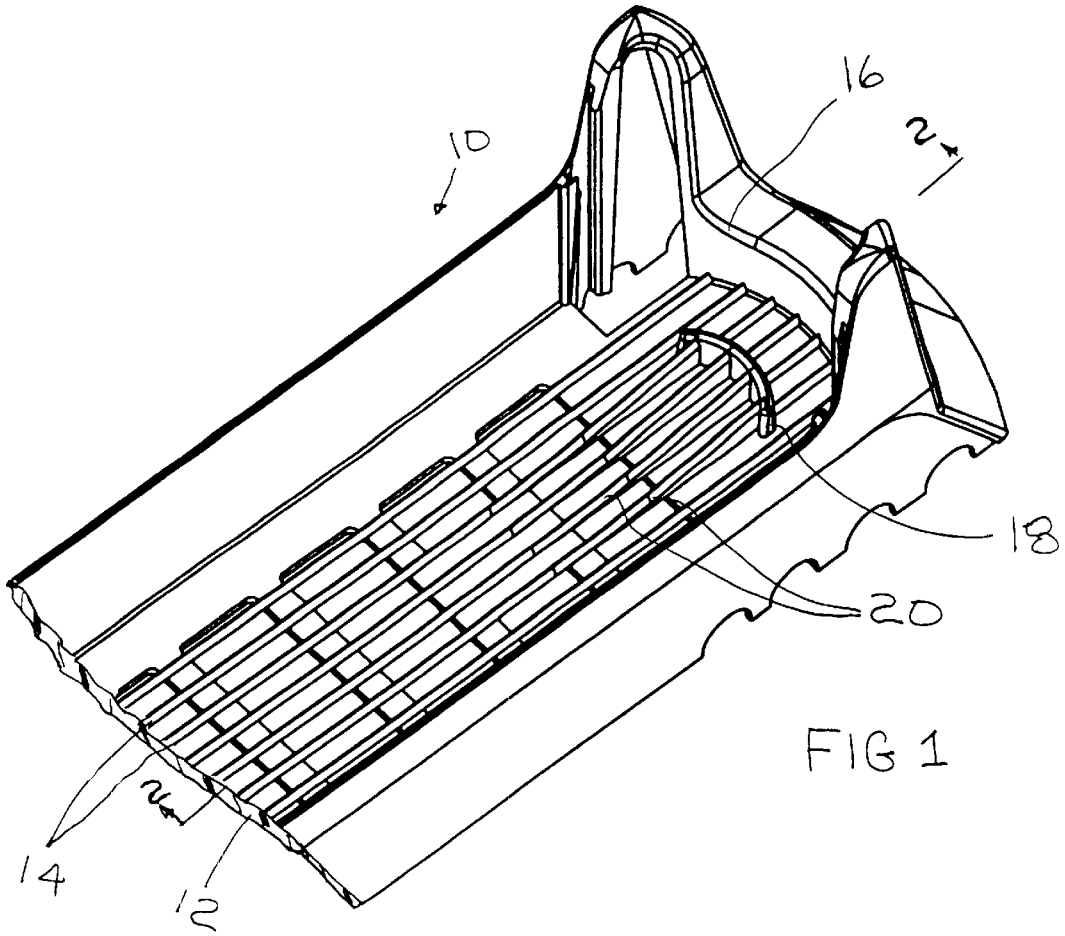
FIG. 1 is a perspective view of a preferred embodiment of a track device incorporating a bottle ramp according to the present invention.
Figure 2:
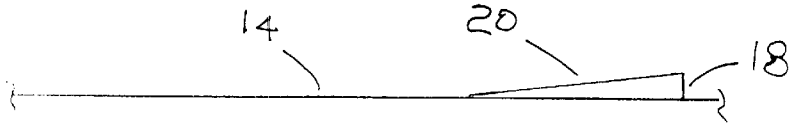
FIG. 2 is a diagrammatic sectional view taken along line 2—2 of FIG. 1.

Referring to FIGS. 1–2, a merchandising display shelf track device 10 for receiving a row of articles for sliding movement therealong is illustrated. A display rack unit is typically assembled from multiple track devices and is designed to merchandise articles such as bottled or canned beverage products. One common form of a display rack unit includes a plurality of elongated track devices detachably interconnected in side-by-side relationship. The exact number of track devices used to assemble the display rack unit is determined such that the size of the unit is suitable for placement onto an existing display shelf in a retail environment. The interconnection of two adjacent track devices is conventionally achieved by connecting means such as connector slots cooperating with L-shaped horizontal connector elements. Details of such track devices and connector elements are more fully described in U.S. Pat. No. 5,634,564, which issued Jun. 3, 1997 to Spamer et al., the disclosure of which is incorporated herein by reference. These track devices do not share a common sidewall but other track devices may share a common sidewall as is known in the art. Other track devices take the form of single or multiple inserts for rows of articles to slide along. Details of such track devices are more fully described in U.S. Pat. No. 5,022,535, which issued Jun. 11, 1991 to Spamer, the disclosure of which is incorporated herein by reference.

The display track device 10 has a front track segment with a base wall 12 extending longitudinally in the direction that the articles slide. Base wall 12 preferably has a plurality of longitudinally extending parallel ribs 14 that support the articles in a friction reducing way. A stop member 16 on the front end of the front segment of the track device stops forward motion of the articles while allowing full identifying viewing of product labeling.

An upstanding riser panel 18 is positioned on the front portion of the base wall 12. Connection of riser panel 18 may be made to the floor of the base wall, to one or more of the parallel ribs 14, and/or to one or more inclined ribs 20. Riser panel 18 is preferably arcuate having a middle portion extending forward toward the front of the track device with the end portions trailing behind. Riser panel 18 extends transversely across the base wall, preferably, for less than the full width of the base wall. The dimensions of the riser panel will vary with the size and type of article that will slide along it.

At least one, but preferably, a plurality of inclined ribs 20 are upstanding from the base wall 12 or from the parallel ribs 14 and are preferably attached to the riser panel 18. Each of the inclined ribs has a front portion, a rear portion and a top surface extending over the front and rear portions. The rear portion of each inclined rib is attached to and contiguous with the rear portion of the base wall so that an article can make a smooth transition from the base wall onto the inclined ribs. The front portion of each inclined rib rises up from the front portion of the base wall or the parallel ribs above the tops of the parallel ribs. The top surface of each rib rises from a position contiguous at the rear portion of the base wall to a position lying above the front portion of the base wall.

The inclined ribs 20 may have different lengths to accommodate a curved riser 18. The riser panel 18 is narrower in width than the base wall and narrow enough to fit into the indentation in the bottom of a bottle. The riser panel 18 is spaced from the front stop member 16 a distance sufficient to allow the front ridge on the bottom of a bottle to clear the riser so that the curved bottom can rest on top of the riser panel.

As a bottle gravity feeds down the track device, its momentum vector is directed parallel to the longitudinal axis of the track device until the ramp is encountered. As the bottle negotiates the ramp, the momentum vector changes so that it has an upward vertical component as well as an axial component. Adding the vertical component reduces the axial component thereby decreasing the tendency for the bottle to tip over. As the leading lip edge of the bottle slides forward off the inclined ribs and over the riser, it falls downward changing the upward vertical momentum component to a downward momentum component effectively shifting the center of gravity lower thereby further resisting tipping.

It can now be appreciated that a merchandising display shelf track device is adapted to receive a row of bottles for sliding movement therealong. A front track segment of the device has a base wall with front and rear portions and a ramp assembly. The ramp assembly has at least one inclined rib and a riser and is attached to the base wall. The rib has a front portion, a rear portion and a top surface extending over the front and rear portions. The rear portion is attached to and contiguous with the rear portion of the base wall. The front portion rises up from the front portion of the base wall. The top surface rises from being contiguous at the rear portion of the base wall to a position above the front portion of the base wall. The riser extends between the base wall and the top surface at the front portion of the base wall.

While the invention has been described with particular reference to the preferred embodiments, it will be understood by those skilled in the art that various changes may be made and equivalents may be substituted for elements of the preferred embodiments without departing from invention. As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A merchandising display shelf track device adapted to receive a row of articles for sliding movement therealong, comprising:

a front track segment having a base wall with a front portion, a rear portion and a plurality of parallel ribs; and a ramp assembly attached to said base wall, said ramp assembly having at least one inclined rib and a riser panel, said at least one inclined rib having a front portion, a rear portion and a top surface extending between said front and rear portions thereof, said rear portion of said at least one inclined rib being attached to and contiguous with said rear portion of said base wall, said front portion of said at least one inclined rib rising up from said front portion of said base wall, said top surface of said at least one inclined rib rising from being contiguous at the rear portion of said base wall to a position above said front portion of said base wall and above said plurality of parallel ribs, said riser panel extending between said base wall and said top surface of said at least one inclined rib at said front portion of said base wall.

2. A merchandising display shelf track device, as set forth in claim 1, wherein said riser panel is curved and has end portions and a middle portion between said end portions, said middle portion of said riser panel extending forward toward said front portion of said base wall more than said end portions of said riser panel.

3. A merchandising display shelf track device, as set forth in claim 1, wherein said riser panel is narrower in effective width than said base wall so that said riser panel spans less than the full width of said base wall.

4. A merchandising display shelf track device, as set forth in claim 1, including a stop member attached to said front track segment, said riser panel being spaced a preselected distance from said stop member.

5. A merchandising display shelf track device adapted to receive a row of articles for sliding movement therealong, comprising:

a front track segment having a base wall with a front portion, a rear portion and a plurality of parallel ribs;

a riser panel upstanding from said front portion of said base wall and extending above said plurality of parallel ribs; and a plurality of inclined ribs upstanding from said base wall and attached to said riser panel, each of said inclined ribs having a front portion, a rear portion and a top surface extending between said front and rear portions thereof, said rear portion of said inclined ribs being attached to and contiguous with said rear portion of said base wall, said front portion of said inclined ribs rising up from said front portion of said base wall and extending above said plurality of parallel ribs, said top surface of said inclined ribs rising from being contiguous at said rear portion of said base wall to a position above said front portion of said base wall and above said plurality of parallel ribs.

6. A merchandising display shelf track device, as set forth in claim 5, wherein said riser panel is curved and intersects said inclined ribs, said inclined ribs having different lengths from said rear portion of said base wall to said riser panel.

7. A merchandising display shelf track device, as set forth in claim 5, wherein said riser panel is curved and has end portions and a middle portion between said end portions, said middle portion of said riser panel extending forward toward said front portion of said base wall more than said end portions of said riser panel.

8. A merchandising display shelf track device, as set forth in claim 5, wherein said riser panel is narrower in effective width than said base wall so that said riser panel spans less than the full width of said base wall.

9. A merchandising display shelf track device, as set forth in claim 5, including a stop member attached to said front track segment, said riser panel being spaced a preselected distance from said stop member.

10. A merchandising display shelf track device adapted to receive a row of articles for sliding movement therealong, comprising:

a front track segment having a base wall with a front portion, a rear portion and a plurality of parallel ribs;

a curved riser panel upstanding from said front portion of said base wall, said riser panel spanning a lateral distance less than the width of said base wall;

at least one inclined rib upstanding from said base wall and attached to said riser panel, said at least one inclined rib having a front portion, a rear portion and a top surface extending between said front and rear portions thereof, said rear portion of said at least one inclined rib being attached to and contiguous with said rear portion of said base wall, said front portion of said at least one inclined rib rising up from said front portion of said base wall, said top surface of said at least one inclined rib rising from an elevation even with said plurality of parallel ribs at said rear portion of said base wall to an elevation above said plurality of parallel ribs at said front portion of said base wall; and a stop member attached to said front track segment, said riser panel being spaced a preselected distance from said stop member.

* * * * *